US008376213B2

(12) United States Patent
Brand

(10) Patent No.: US 8,376,213 B2
(45) Date of Patent: Feb. 19, 2013

(54) CARRIER WITH LOCKING FEATURES

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 502 days.

(21) Appl. No.: 12/578,718

(22) Filed: Oct. 14, 2009

(65) Prior Publication Data

US 2010/0089988 A1 Apr. 15, 2010

Related U.S. Application Data

(60) Provisional application No. 61/196,055, filed on Oct. 14, 2008, provisional application No. 61/201,047, filed on Dec. 5, 2008.

(51) Int. Cl.
*B65D 5/02* (2006.01)
*B65D 5/42* (2006.01)
*B31B 49/02* (2006.01)

(52) U.S. Cl. ..... 229/185; 229/103.2; 206/140; 206/427

(58) Field of Classification Search ..... 229/128, 229/198.2; 53/484; 206/140
See application file for complete search history.

(56) References Cited

U.S. PATENT DOCUMENTS

| | | | | |
|---|---|---|---|---|
| 2,849,111 | A | 8/1958 | Fielding | |
| RE24,667 | E | 7/1959 | Fielding | |
| 2,922,561 | A | 1/1960 | Currivan | |
| 2,928,541 | A | 3/1960 | Fielding | |
| 2,929,497 | A | 3/1960 | De Million-Czarnecki | |
| 3,178,242 | A | 4/1965 | Ellis | |
| 3,237,762 | A | 3/1966 | Wood | |
| 3,252,649 | A | 5/1966 | Graser et al. | |
| 3,300,115 | A | 1/1967 | Schauer | |
| 3,306,519 | A | 2/1967 | Wood | |
| 3,339,723 | A | 9/1967 | Wood | |
| 3,343,660 | A * | 9/1967 | Bailey | 229/114 |
| 3,356,279 | A | 12/1967 | Root | |
| 3,373,867 | A | 3/1968 | Wood | |
| 3,429,496 | A | 2/1969 | Hickin | |
| 3,447,672 | A * | 6/1969 | Bailey et al. | 229/104 |

(Continued)

FOREIGN PATENT DOCUMENTS

| | | |
|---|---|---|
| BE | 671.762 | 3/1996 |
| CA | 2542350 | 5/2005 |

(Continued)

OTHER PUBLICATIONS

International Search Report and Written Opinion—PCT/US2009/060588, mailed Feb. 8, 2010.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton for carrying a plurality of articles and a blank for forming the carton generally include a top panel, a first side panel foldably connected to the top panel, a second side panel foldably connected to the top panel, a first bottom panel foldably connected to the first side panel, the first bottom panel comprising a plurality of female locking openings and having opening flaps adjacent the female locking openings. The opening flaps are foldably connected to the first bottom panel at respective first arcuate fold lines. A second bottom panel is foldably connected to the second side panel. The second bottom panel comprises a plurality of male locking projections. The male locking projections are foldably connected to the second bottom panel at respective second arcuate fold lines.

35 Claims, 10 Drawing Sheets

U.S. PATENT DOCUMENTS

| | | | |
|---|---|---|---|
| 3,517,858 | A | 6/1970 | Farquhar |
| 3,593,849 | A | 7/1971 | Helms |
| 3,635,452 | A | 1/1972 | Helms |
| 3,669,342 | A | 6/1972 | Funkhouser |
| 3,669,343 | A | 6/1972 | Howard |
| 3,747,835 | A | 7/1973 | Graser |
| 3,767,042 | A | 10/1973 | Ganz |
| 3,963,121 | A | 6/1976 | Kipp |
| 4,004,500 | A | 1/1977 | Wood |
| 4,010,593 | A | 3/1977 | Graham |
| 4,096,985 | A | 6/1978 | Wood |
| 4,101,069 | A | 7/1978 | Wood |
| 4,200,220 | A | 4/1980 | Ganz |
| 4,202,446 | A | 5/1980 | Sutherland |
| 4,328,893 | A | 5/1982 | Oliff et al. |
| 4,394,903 | A | 7/1983 | Bakx |
| 4,421,232 | A | 12/1983 | Konaka |
| 4,424,901 | A | 1/1984 | Lanier |
| 4,440,340 | A | 4/1984 | Bakx |
| 4,566,593 | A | 1/1986 | Muller |
| 4,747,487 | A | 5/1988 | Wood |
| 4,784,266 | A | 11/1988 | Chaussadas |
| 4,804,089 | A | 2/1989 | Wilson |
| 4,860,943 | A | 8/1989 | Cooper |
| 4,875,585 | A | 10/1989 | Kadleck et al. |
| 4,901,849 | A | 2/1990 | Wilson |
| 4,919,266 | A | 4/1990 | McIntosh, Jr. et al. |
| 4,966,324 | A | 10/1990 | Steel |
| 4,972,991 | A | 11/1990 | Schuster |
| 5,000,313 | A | 3/1991 | Oliff |
| 5,042,660 | A | 8/1991 | Carver |
| 5,060,792 | A | 10/1991 | Oliff |
| 5,131,588 | A | 7/1992 | Oliff |
| 5,180,100 | A | 1/1993 | Shimizu |
| 5,195,676 | A | 3/1993 | LeBras |
| 5,246,112 | A | 9/1993 | Stout et al. |
| 5,297,673 | A | 3/1994 | Sutherland |
| 5,351,878 | A | 10/1994 | Cooper |
| 5,395,043 | A | 3/1995 | Bacques et al. |
| 5,421,458 | A | 6/1995 | Campbell |
| 5,443,203 | A | 8/1995 | Sutherland |
| 5,472,090 | A | 12/1995 | Sutherland |
| 5,472,138 | A | 12/1995 | Ingram |
| 5,485,915 | A | 1/1996 | Harris |
| 5,505,372 | A | 4/1996 | Edson et al. |
| 5,542,536 | A | 8/1996 | Sutherland |
| 5,551,556 | A | 9/1996 | Sutherland |
| 5,558,212 | A | 9/1996 | Sutherland |
| 5,558,213 | A | 9/1996 | Sutherland |
| 5,597,071 | A | 1/1997 | Sutherland |
| 5,609,251 | A | 3/1997 | Harris |
| 5,664,401 | A | 9/1997 | Portrait et al. |
| 5,682,995 | A | 11/1997 | Sutherland |
| 5,692,614 | A | 12/1997 | Harris |
| 5,704,542 | A | 1/1998 | Harrelson |
| 5,778,630 | A | 7/1998 | Portrait et al. |
| 5,782,343 | A | 7/1998 | Harrelson |
| 5,853,088 | A | 12/1998 | Saulas et al. |
| 5,855,318 | A | 1/1999 | Baxter |
| 5,931,300 | A | 8/1999 | Sutherland |
| 5,937,620 | A | 8/1999 | Chalendar |
| 5,941,453 | A | 8/1999 | Oliff |
| 5,943,847 | A | 8/1999 | Chalendar |
| 5,947,367 | A | 9/1999 | Miller et al. |
| 5,975,286 | A | 11/1999 | Oliff |
| 6,019,220 | A | 2/2000 | Sutherland |
| 6,021,898 | A | 2/2000 | Sutherland |
| 6,021,899 | A | 2/2000 | Sutherland |
| 6,085,969 | A | 7/2000 | Burgoyne |
| 6,109,438 | A | 8/2000 | Sutherland |
| 6,155,480 | A | 12/2000 | Botsford et al. |
| 6,158,586 | A | 12/2000 | Muller |
| 6,227,367 | B1 | 5/2001 | Harrelson et al. |
| 6,283,293 | B1 | 9/2001 | Lingamfelter |
| 6,289,651 | B1 | 9/2001 | Le Bras |
| 6,315,123 | B1 | 11/2001 | Ikeda |
| 6,378,697 | B1 | 4/2002 | Sutherland et al. |
| 6,378,765 | B1 | 4/2002 | Sutherland |
| 6,550,616 | B2 | 4/2003 | Le Bras |
| 6,789,673 | B2 | 9/2004 | Lingamfelter |
| 6,811,525 | B2 | 11/2004 | Culpepper |
| 6,866,185 | B2 | 3/2005 | Harrelson |
| 6,948,651 | B2 | 9/2005 | Ikeda |
| 6,981,631 | B2 | 1/2006 | Fogle et al. |
| 6,988,617 | B2 | 1/2006 | Gomes et al. |
| 7,007,800 | B2 | 3/2006 | Le Bras |
| 7,025,197 | B2 | 4/2006 | Sutherland |
| 7,159,759 | B2 | 1/2007 | Sutherland |
| 7,175,020 | B2 | 2/2007 | Sutherland et al. |
| 7,427,010 | B2 | 9/2008 | Sutherland |
| 7,448,492 | B2 | 11/2008 | Sutherland |
| 7,644,817 | B2 | 1/2010 | Sutherland |
| 7,677,387 | B2 | 3/2010 | Brand et al. |
| 7,762,395 | B2 | 7/2010 | Sutherland et al. |
| 7,762,397 | B2 | 7/2010 | Coltr-Johnson et al. |
| 2003/0000182 | A1 | 1/2003 | Portrait et al. |
| 2003/0132130 | A1 | 7/2003 | Bras |
| 2004/0000582 | A1 | 1/2004 | Sutherland |
| 2004/0011674 | A1 | 1/2004 | Theelen |
| 2004/0069659 | A1 | 4/2004 | Sutherland |
| 2004/0089671 | A1 | 5/2004 | Miller |
| 2004/0188277 | A1 | 9/2004 | Auclair |
| 2004/0188301 | A1 | 9/2004 | Gomes |
| 2004/0243277 | A1 | 12/2004 | Bonnain et al. |
| 2004/0254666 | A1 | 12/2004 | Bonnain et al. |
| 2005/0001020 | A1 | 1/2005 | Gamier |
| 2005/0103652 | A1 | 5/2005 | Wilkins |
| 2005/0167290 | A1 | 8/2005 | Sutherland |
| 2005/0178791 | A1 | 8/2005 | Miller |
| 2005/0194430 | A1 | 9/2005 | Auclair et al. |
| 2006/0157545 | A1 | 7/2006 | Auclair |
| 2006/0191811 | A1 | 8/2006 | Fogle et al. |
| 2006/0255108 | A1 | 11/2006 | Shmagin |
| 2007/0017829 | A1 | 1/2007 | Sutherland |
| 2007/0241017 | A1 | 10/2007 | Sutherland et al. |
| 2010/0072267 | A1 | 3/2010 | May et al. |

FOREIGN PATENT DOCUMENTS

| | | | |
|---|---|---|---|
| DE | 91 04 905.9 | | 6/1991 |
| DE | 92 03 858.1 | | 5/1992 |
| EP | 0 459 658 | A1 | 12/1991 |
| EP | 0 509 749 | A1 | 10/1992 |
| EP | 0520 411 | A1 | 12/1992 |
| FR | 2 698 074 | | 5/1994 |
| JP | 41-18199 | | 10/1941 |
| JP | 5-112373 | | 5/1993 |
| JP | 2003252323 | | 9/2003 |
| WO | WO 97/27124 | | 7/1977 |
| WO | 0078634 | A1 | 12/2000 |
| WO | WO 02/102208 | A1 | 12/2002 |
| WO | WO 03/008292 | A2 | 1/2003 |
| WO | WO 2004/087507 | A2 | 10/2004 |
| WO | WO 2005/092735 | A2 | 10/2005 |
| WO | WO 2005/042370 | A1 | 12/2005 |
| WO | WO 2007/019000 | A2 | 2/2007 |
| WO | WO 2007/126977 | A2 | 11/2007 |
| WO | WO 2009/015320 | A2 | 1/2009 |

OTHER PUBLICATIONS

Supplementary European Search Report for EP 09 81 6780 dated Jan. 17, 2012.

Office Action for CA 2,737,657, dated Jan. 9, 2012.

Office Action for CA 2,738,060, dated Feb. 6, 2012.

* cited by examiner

CARRIER WITH LOCKING FEATURES

CROSS-REFERENCE TO RELATED APPLICATIONS

This application claims the benefit of U.S. Provisional Application No. 61/196,055, which was filed on Oct. 14, 2008, and U.S. Provisional Application No. 61/201,047, which was filed on Dec. 5, 2008.

INCORPORATION BY REFERENCE

U.S. Provisional Application No. 61/196,055, which was filed on Oct. 14, 2008, and U.S. Provisional Application No. 61/201,047, which was filed on Dec. 5, 2008 are hereby incorporated by reference for all purposes as if presented herein in their entirety.

BACKGROUND OF THE DISCLOSURE

The present disclosure generally relates to locks for carriers for holding and dispensing beverage containers or other types of articles.

SUMMARY OF THE DISCLOSURE

In general, one aspect of the disclosure is directed to a carton for carrying a plurality of articles. The carton comprises a top panel, a first side panel foldably connected to the top panel, a second side panel foldably connected to the top panel, and a first bottom panel foldably connected to the first side panel. The first bottom panel comprises a plurality of female locking openings and having a plurality of opening flaps. A respective one of the opening flaps is adjacent a respective one of the female locking openings and is respectively foldably connected to the first bottom panel at a respective first arcuate fold line. A second bottom panel foldably connected to the second side panel. The second bottom panel comprises a plurality of male locking projections, each of the male locking projections is respectively foldably connected to the second bottom panel at a respective second arcuate fold line.

In another aspect, the disclosure is generally directed to a blank for forming a carton for carrying a plurality of articles. The blank comprises a top panel, a first side panel foldably connected to the top panel, a second side panels foldably connected to the top panel, and a first bottom panel foldably connected to the first side panel. The first bottom panel comprises a plurality of female locking openings and having a plurality of opening flaps. A respective one of the opening flaps is adjacent a respective one of the female locking openings and is respectively foldably connected to the first bottom panel at a respective first arcuate fold line. A second bottom panel is foldably connected to the second side panel. The second bottom panel comprises a plurality of male locking projections. Each of the male locking projections is respectively foldably connected to the second bottom panel at a respective second arcuate fold line.

In another aspect, the disclosure is generally directed to a method of forming a carton. The method comprises obtaining a blank. The blank comprises a top panel, a first side panel foldably connected to the top panel, a second side panels foldably connected to the top panel, and a first bottom panel foldably connected to the first side panel. The first bottom panel comprises a plurality of female locking openings and has a plurality of opening flaps. A respective one of the opening flaps is adjacent a respective one of the female locking openings and is respectively foldably connected to the first bottom panel at a respective first arcuate fold line. The blank further comprises a second bottom panel foldably connected to the second side panel. The second bottom panel comprises a plurality of male locking projections. Each of the male locking projections is respectively foldably connected to the second bottom panel at a respective second arcuate fold line. The method comprises at least partially overlapping the first bottom panel and the second bottom panel, inserting the male locking projections into a corresponding female locking opening, and placing the male locking projections into interlocking engagement with a corresponding female locking opening.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons, carriers, packages, containers, etc., that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., aluminum beverage cans) as disposed within the carrier embodiments. In this specification, the terms "lower," "bottom," "upper" and "top" indicate orientations determined in relation to fully erected and upright cartons.

Figure 1:
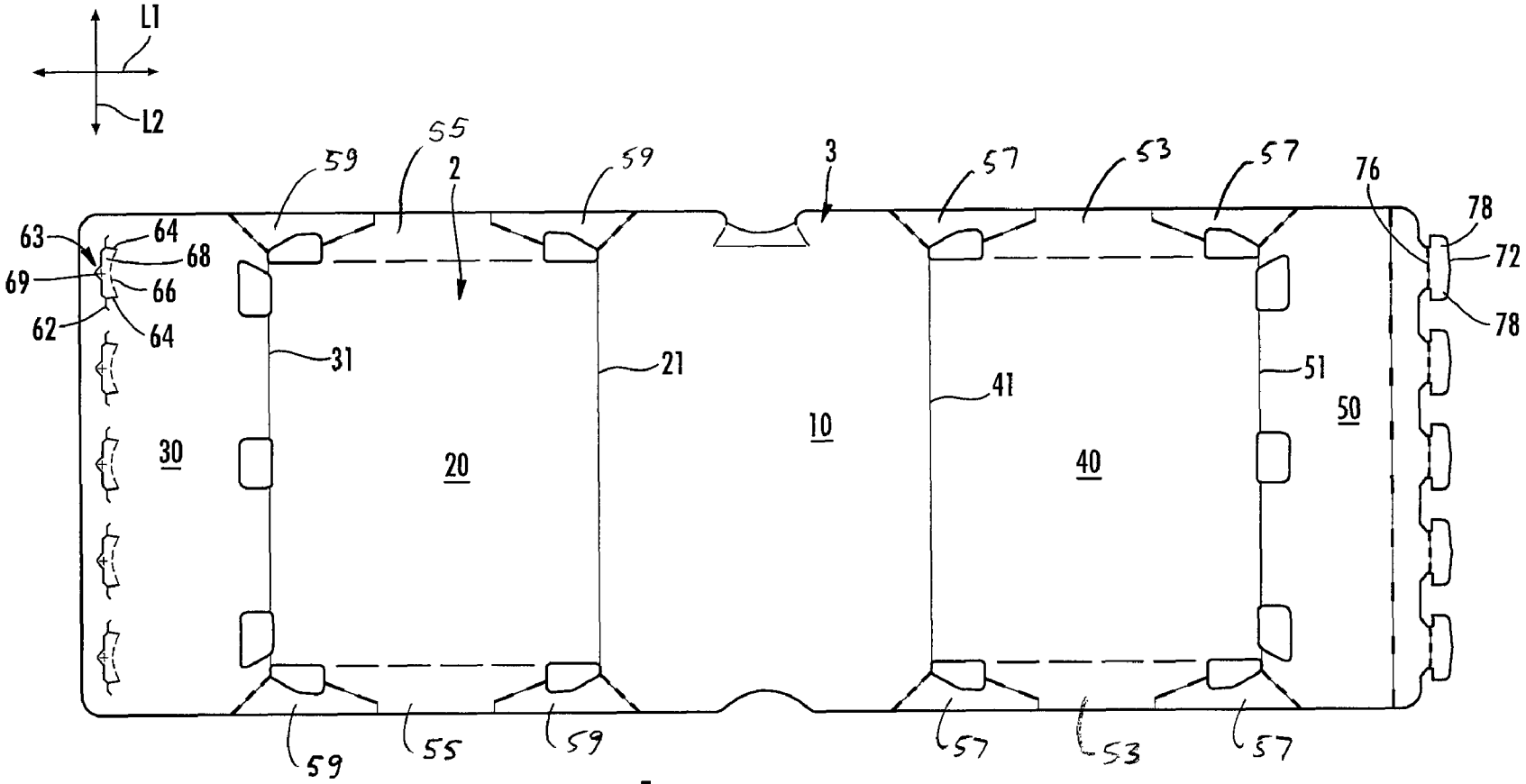
FIG. 1 is a plan view of an exterior surface of a blank used to form a carrier according to a first embodiment of the present disclosure.
Figure 3A:
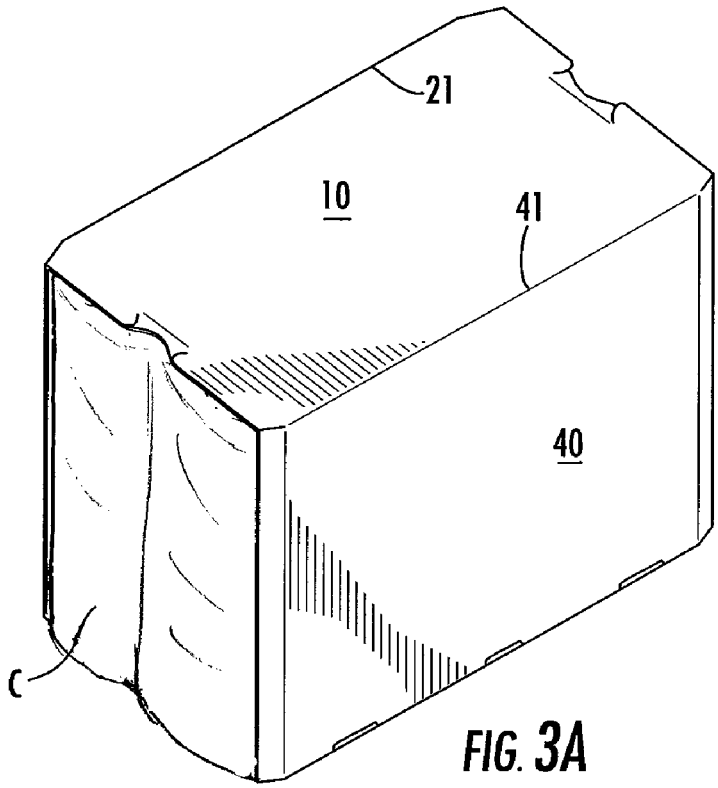
FIG. 3A is a top perspective view of a carrier formed from the blank of FIG. 1.
Figure 3B:
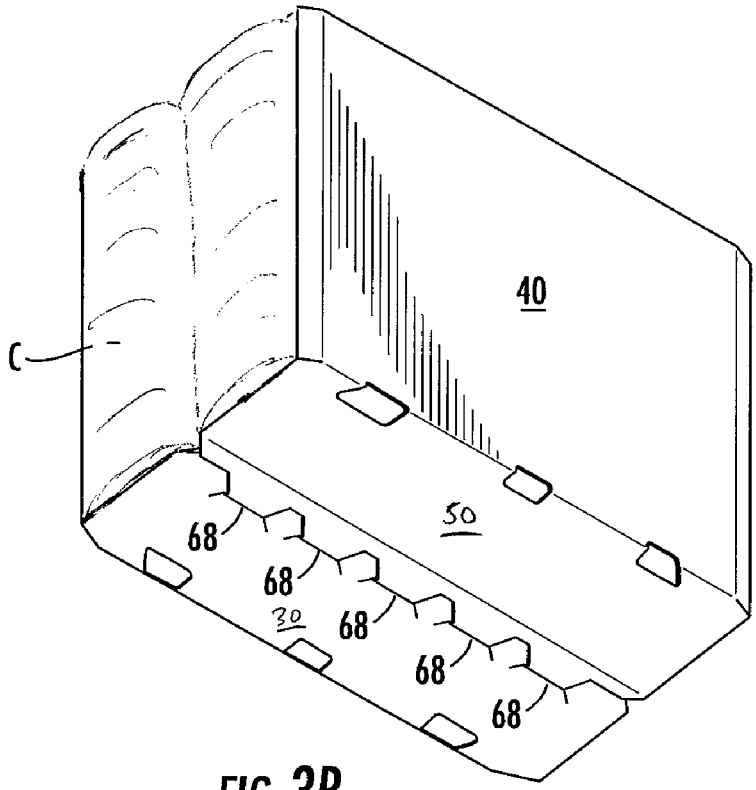
FIG. 3B is a bottom perspective view of a carrier according formed from the blank of FIG. 1.
Figure 4:
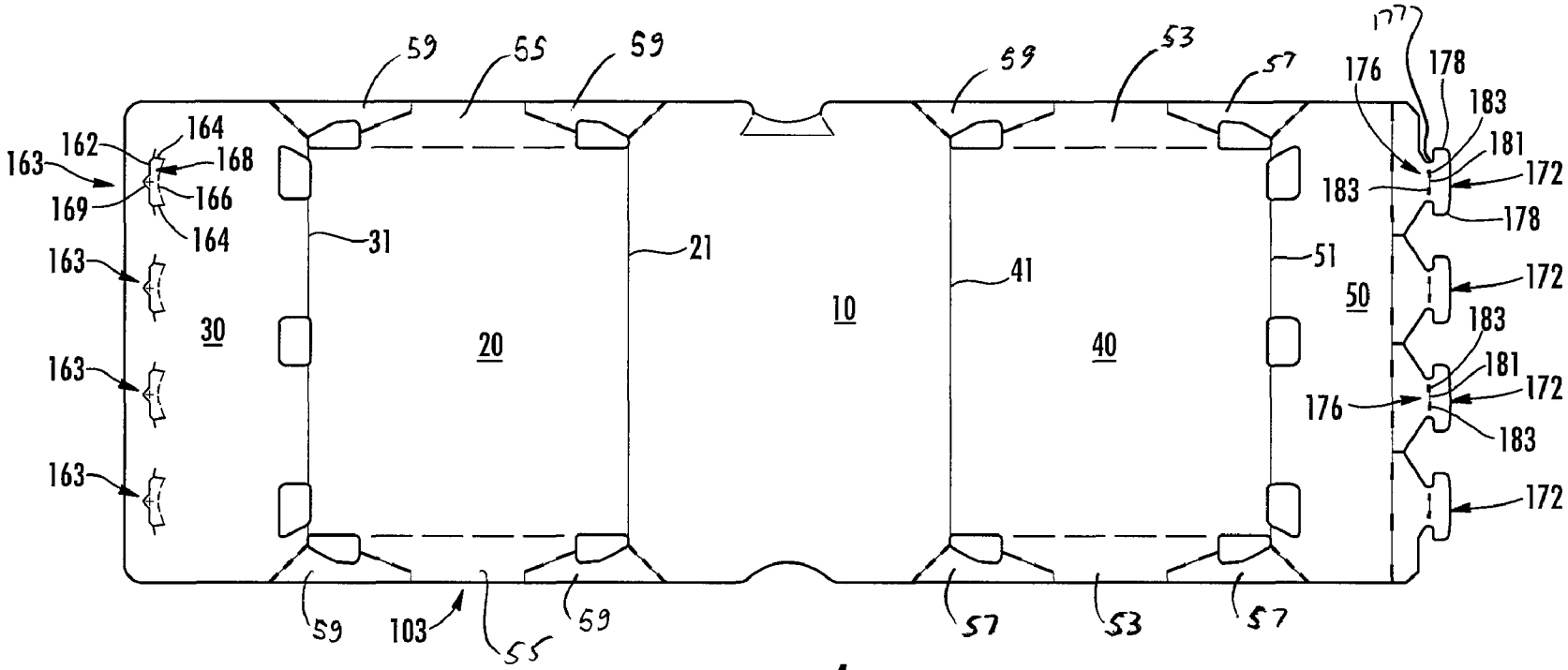
FIG. 4 is a plan view of an exterior surface of a blank used to form a carrier according to a second embodiment of the present disclosure.
Figure 5:
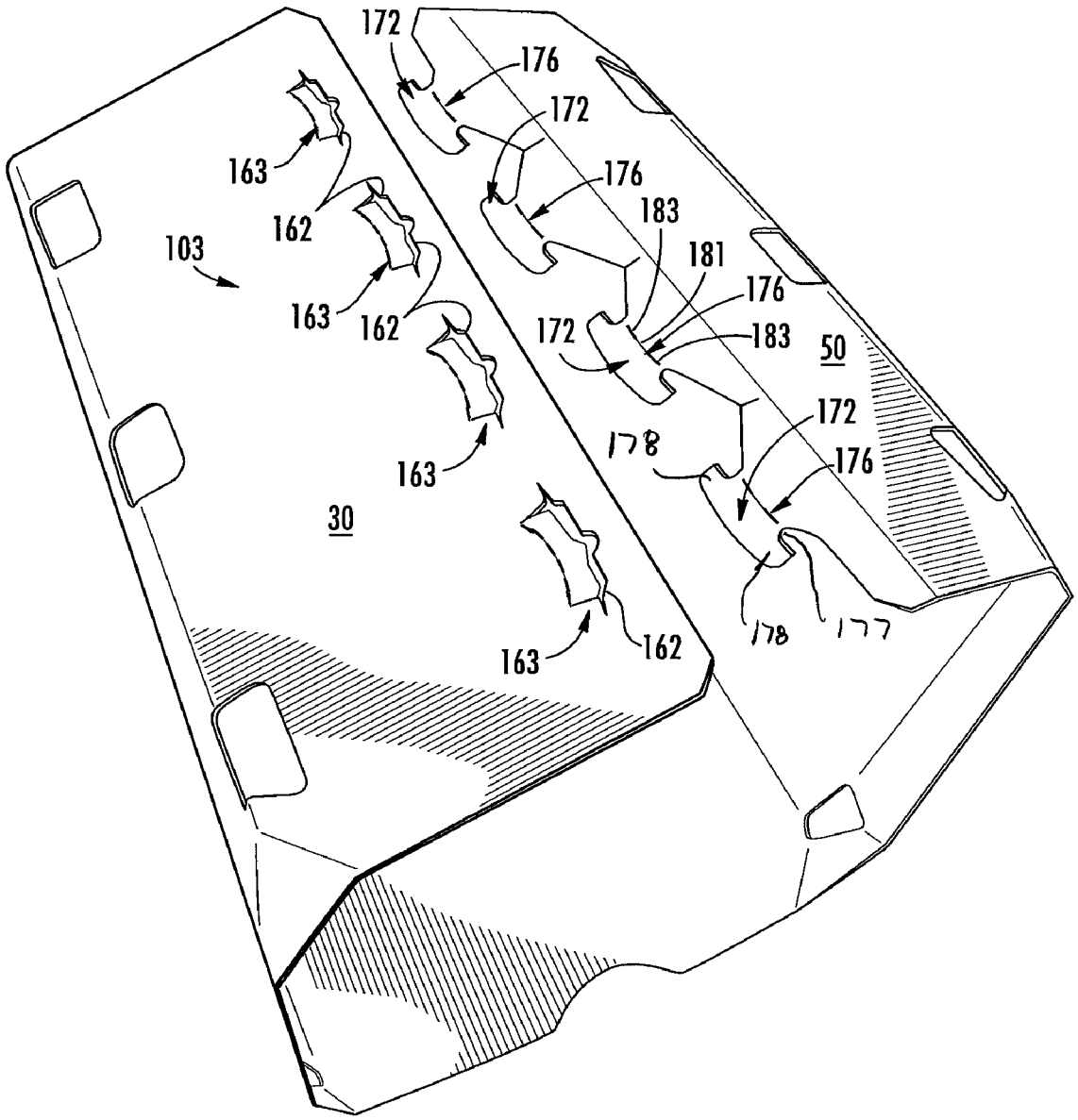
FIG. 5-7 show the blank of FIG. 4 being formed into a carrier.

FIG. 1 is a plan view of an exterior surface 2 of a blank 3, used to form a carrier, shown in FIGS. 3A and 3B, according to one embodiment of the disclosure. The carrier can be used to house a plurality of articles such as containers C. The containers C can be beverage cans and the blank 3 is sized to form a carrier that houses six containers in a single layer in a 2×3 arrangement. But, it is understood that the blank 3 and/or carrier may be sized and shaped to hold containers of a different or same quantity in more than one layer and/or in different row/column arrangements (e.g., 1×6, 2×6, 2×4, 2×2, 2×6×2, 2×4×2, 2×9, etc.). In the illustrated embodiment, the carrier has generally open ends that wrap around the containers (e.g., the carrier may be referred to as a wrap-around carrier). The blank 3 is similar to the blank illustrated in International Application No. PCT/US08/71134, filed Jul. 25, 2008, the entire contents of which are incorporated by reference herein for all purposes. The carrier could be otherwise shaped and arranged such the ends are at least partially closed such as by end flaps (not shown) or other closing mechanisms. Furthermore, the blank 3 can be similar to the blank illustrated in U.S. Pat. No. 7,427,010, issued Sep. 23, 2009, the entire contents of which are incorporated by reference herein for all purposes.

The blank 3 has a longitudinal axis L1 and a lateral axis L2. In the illustrated embodiment, the blank 3 comprises a top panel 10 foldably connected to a first side panel 20 at a first lateral fold line 21, a first bottom panel 30 foldably connected to the first side panel 20 at a second lateral fold line 31, a second side panel 40 foldably connected to the top panel 10 at a third lateral fold line 41, and a second bottom panel 50 foldably connected to the second side panel 40 at a fourth lateral fold line 51. In the illustrated embodiment, the first bottom panel 30 includes a first bevel panel 32 defined by lateral fold lines 33 and 31. The blank 3 can include front and/or rear gusset panels connected to respective panels 10, 20, 30, 40, 50 without departing from the scope of the disclosure. The gusset panels can include tuck-in panels 53, 55 retaining panels 57, 59 similar to the tuck-in panels and retaining panels disclosed in U.S. patent application Ser. No. 11/364,244, filed Feb. 28, 2006, the entire contents of which are incorporated by reference herein for all purposes, or the tuck-in panels and retaining panels can be omitted without departing from this disclosure.

The first bottom panel 30 includes slits 62 forming female locking openings 63. Each of the slits 62 extends generally laterally across the blank in the lateral direction L2 and cooperates with two spaced apart cuts 64 that extend generally from the slits towards the fold line 31. In the illustrated embodiment the slits 62 are not straight and include multiple turns, but the slits could be otherwise shaped without departing from the disclosure. As shown in the illustrated embodiment, the cuts 64 are straight and are angled with respect to the longitudinal axis L1 and lateral axis L2, but the cuts 64 could be otherwise shaped. A curved fold line 66 extends between respective cuts 64. In the illustrated embodiment the fold line 66 is arcuate, but the fold line could be otherwise shaped without departing from this disclosure. The fold line 66, cuts 64, and slit 62 form a foldable flap 68 (broadly "opening flap") for each female locking opening 63. The foldable flaps 68 each include a tab 69 at the free edge of a respective flap. When the foldable flaps 68 are folded out of plane with the remaining portion of the first bottom panel 30, a respective female locking opening 63 is formed. The foldable flap 68 or other features of the female locking opening 63 could be otherwise shaped, arranged, and/or configured without departing from the disclosure.

The second bottom panel 50 includes male locking projections 72 that are shaped for being received in a respective female locking opening 63. In one embodiment, each male locking projection 72 is foldably connected to the second bottom panel 50 at an arcuate fold line 76 that extends across a narrow neck portion 77 of the locking projection. The male locking projections 72 have respective shoulders 78 that extend laterally outward from the narrow neck portion 77. The male locking projection 72 and fold line 76 could be otherwise shaped, arranged, and/or positioned without departing from the disclosure.

The carrier formed from the blank 3 has locking features including the male locking projections 72 which can be inserted into female locking openings 63. When the male locking projections 72 are inserted into the female locking openings 63, the foldable flap 68 is positioned to facilitate receiving the projections in the openings. When the male locking projections 72 are inserted thought the slits 62, the shoulders 78 of the projections engage the portions of the slits that extend beyond the cuts 64 to prevent withdrawal of locking projections. The foldable flap 68 is also biased against the male locking projection 62 to prevent disengagement of the locking projection with a respective female opening 63.

Figure 2:
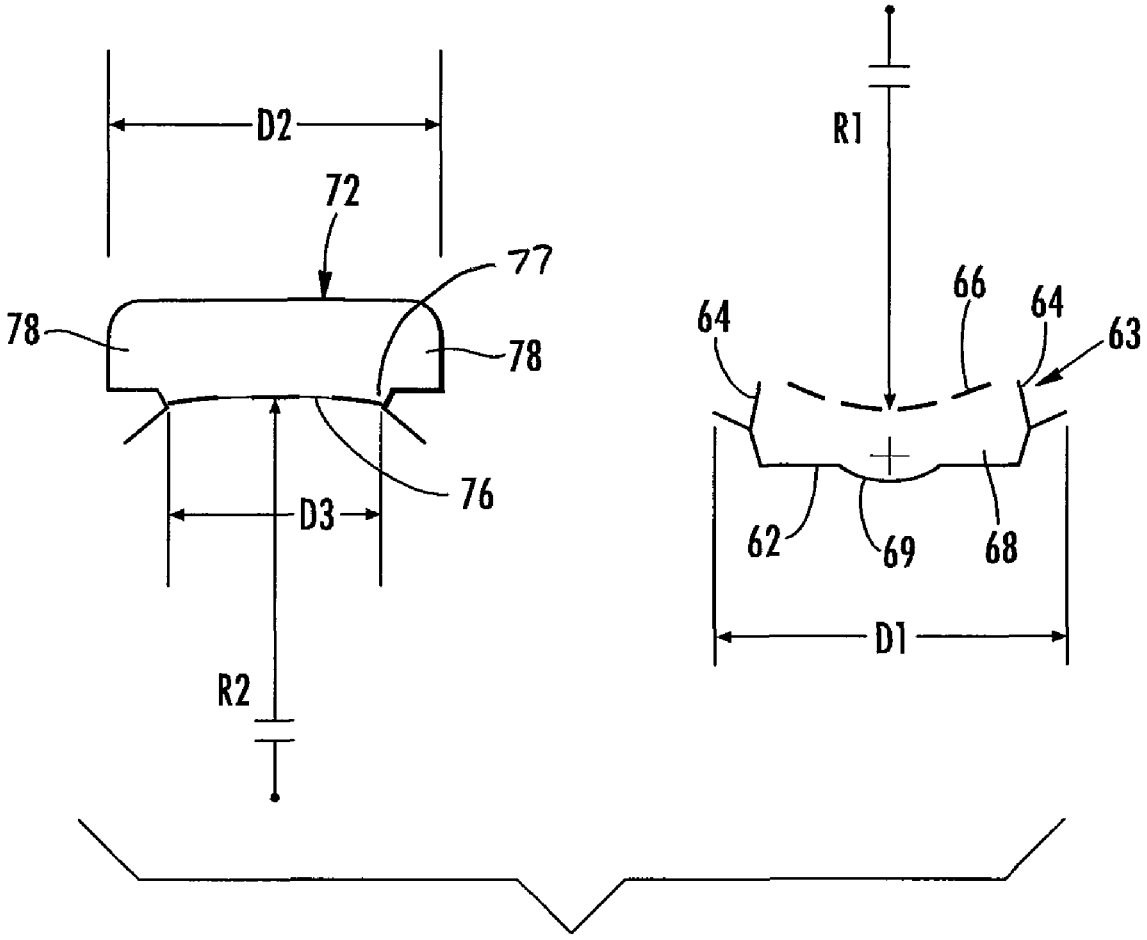
FIG. 2 shows a male projection and a female locking opening of FIG. 1.

As shown in FIG. 2, the slit 62 has an overall length D1 in the lateral direction, and the fold line 66 has a radius R1. The male locking projection 72 has a maximum width D2 in the lateral direction measured across the shoulders 78, and male locking projection has a minimum width D3 in the lateral direction measured across the neck 77. The fold line 76 spanning the neck of the male locking projection 72 has a radius R2. The dimensional information presented herein is illustrated of one embodiment of the disclosure and is not intended to limit the scope of the disclosure. The male locking projection 72 and female locking opening 63 can each have dimensions other than stated herein without departing from the disclosure.

The blank 3 may be similar to the blank disclosed in the above-referenced '134 PCT application or the blank may have similar structure and features of blanks used to form other carriers. For example, the blank 3 may have similar structures, features, uses, etc., as the blanks, cartons, carriers, packages, etc., disclosed in U.S. Pat. Nos. 5,443,203, 5,485,915, 5,782,343, 6,378,765, 6,988,617, 7,175,020, and 7,427,010, the disclosure of each of the aforementioned references is incorporated by reference herein for all purposes. The blank 3 can have other features, structures, functions, etc., and can be for forming a carrier, carton, blank, and/or package, having alternative features, structures, functions, etc., without departing from the scope of this disclosure.

Figure 8:
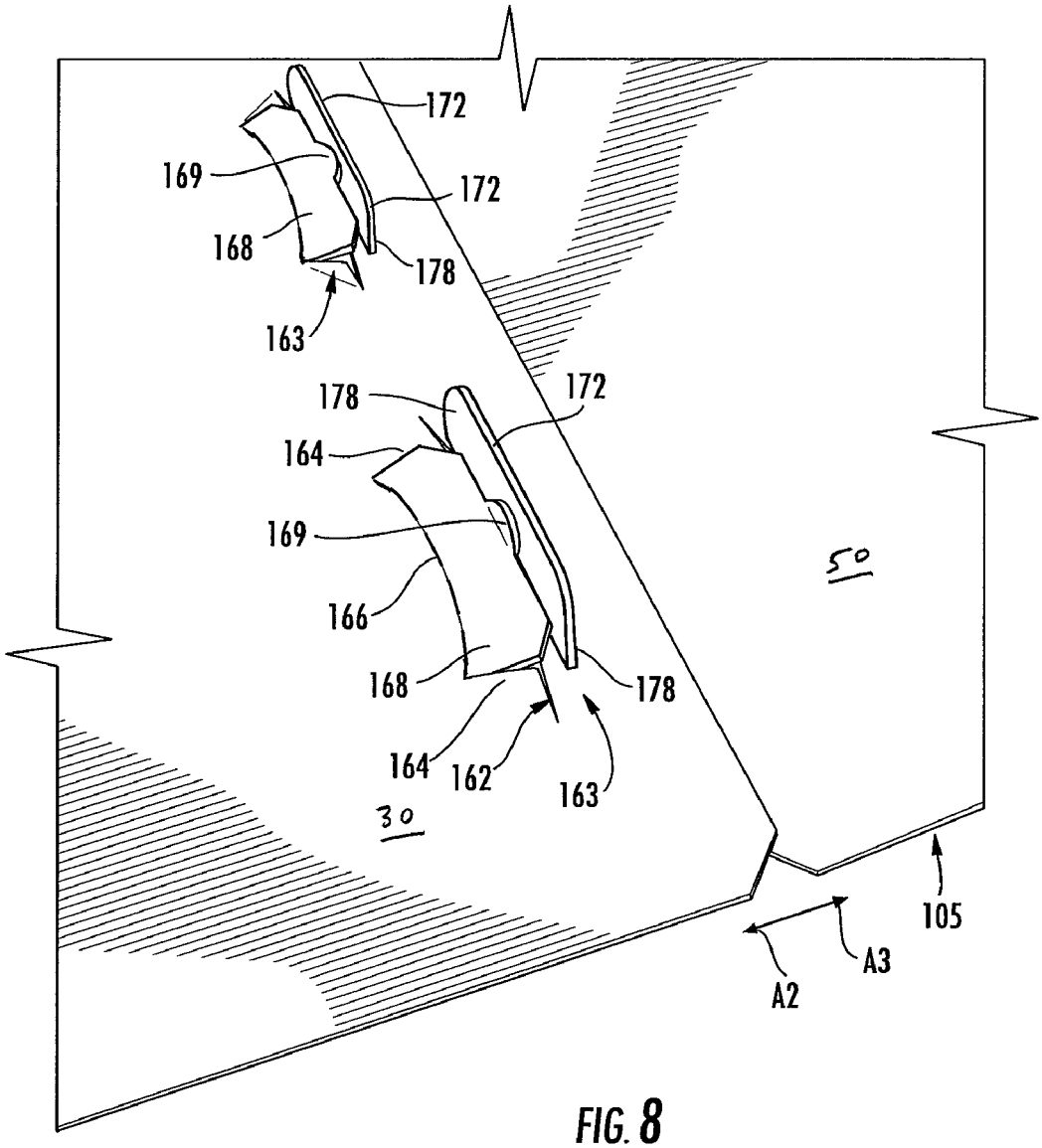
FIG. 8 is a partial view showing a portion of an interior of the carrier.
Figure 9:
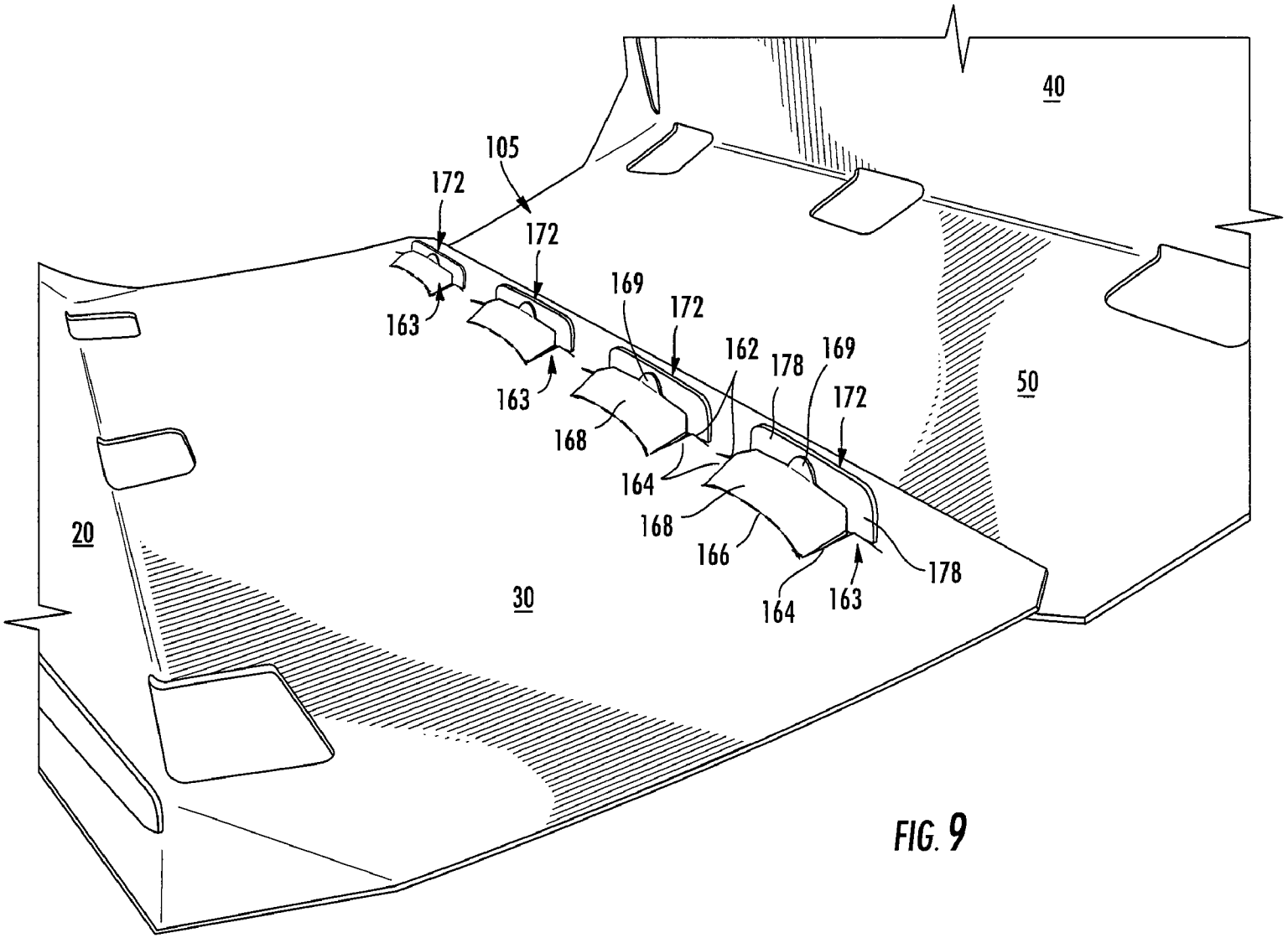
FIG. 9 is a partial view showing an interior of the carrier having interlocked first and second bottom panel.
Figure 10:
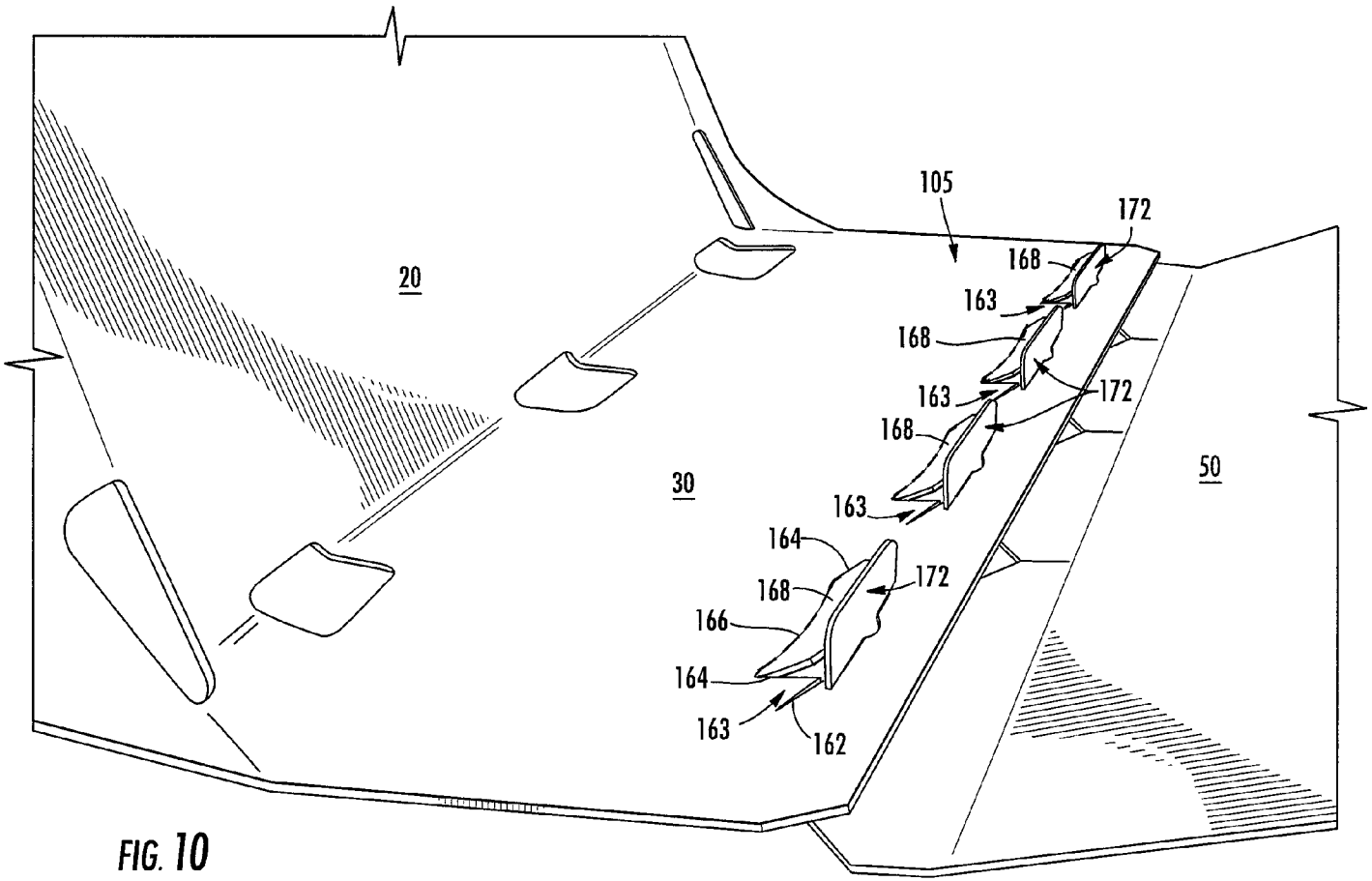
FIG. 10 is a partial view showing an interior of the carrier having interlocked first and second bottom panel.

FIGS. 4-10 illustrate a blank 103 of a second embodiment of the disclosure having similar features as the first embodiment. Accordingly, similar or identical features of the embodiments are provided with identical or similar reference numbers. The blank 103 is for forming a carton or carrier 105 (FIG. 10). The blank 103 includes male locking projections 172 that are foldably connected to the second bottom panel 50 at arcuate fold lines 176. In the second embodiment, the arcuate fold lines 176 are spaced inward from respective edges of the male locking projections 172 that form the neck or narrow portion 177 of the projections that is adjacent the shoulders 178. That is, the arcuate fold lines 176 do not extend completely across the neck 177 of the male locking projections 172. In the illustrated embodiment, the arcuate fold lines 176 comprise a cut line 181, with two fold lines 183 extending from respective opposite ends of the cut line. One or more of the arcuate fold lines 176 may be otherwise formed (e.g., from a continuous fold line, a continuous cut line, or two cut lines and one fold line, etc.) without departing from the disclosure.

In the second embodiment, the female locking openings 163 are identical to the female locking openings 63 of the first embodiment, in that the locking openings of the second embodiment comprise slits 162, cuts 164, curved fold lines 166, foldable flap 168, and tabs 169 that are similar to the respective features of the first embodiment. The female locking openings 163 could be otherwise shaped, arranged, and/or configured without departing from the scope of the disclosure.

Figure 6:
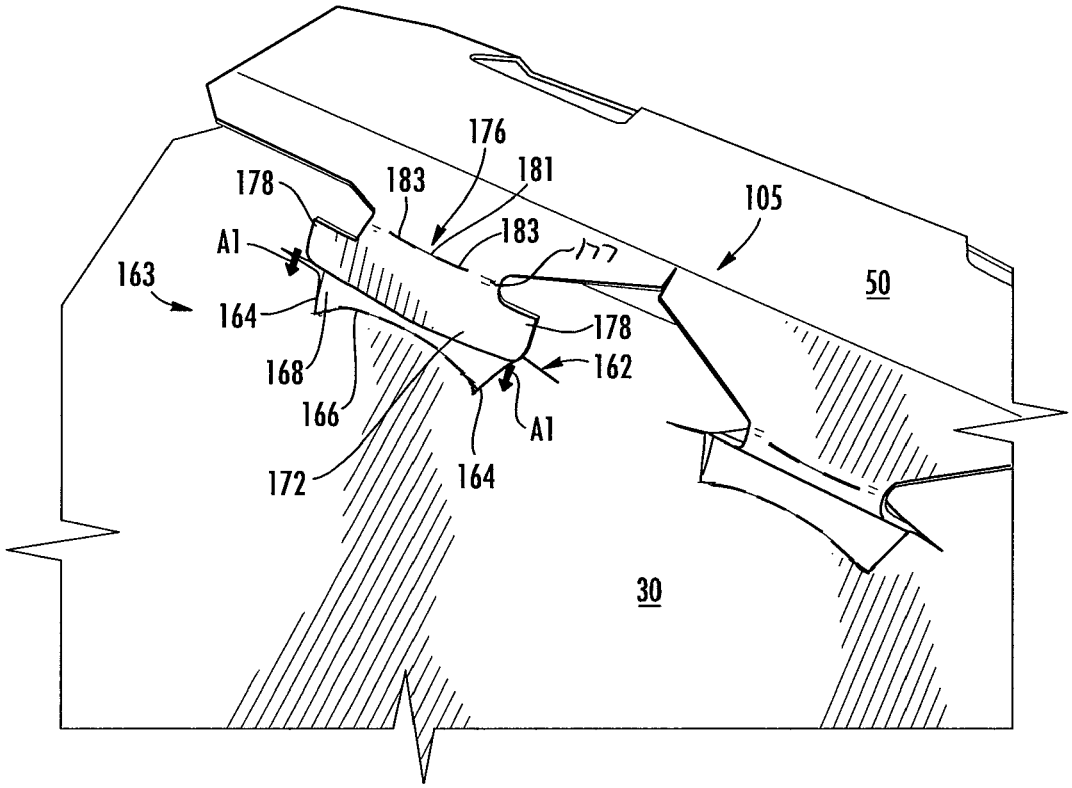
Figure 7:
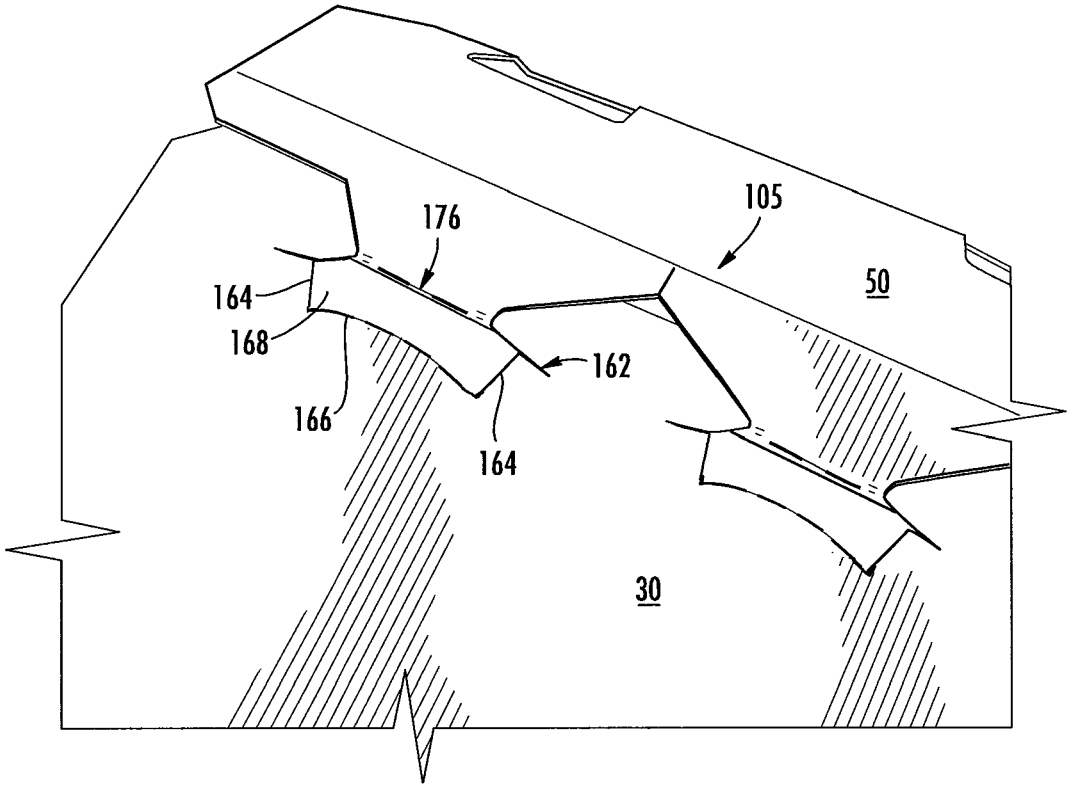

As shown in FIGS. 5-10, the carrier 105 is formed from the blank 103 by overlapping the first and second bottom panels 30, 50 and inserting the male locking projections 172 into the female locking openings 163. As shown in FIGS. 6 and 7, the male locking projections 172 are folded at arcuate fold line 176 so that the male locking projections are generally perpendicular to the second bottom panel 50 and the first bottom panel 30. The male locking projections 172 are positioned above the female locking openings 163 and are moved in the direction of arrow A1 so that the leading edge of the male locking projections is inserted through the slit 162. The leading edge of the male locking projection 172 presses against the foldable flap 168 to fold the foldable flap inward at arcuate fold line 166. The male locking projections 172 are further moved through the openings 163 until the shoulders 178 pass through a respective slit 162. As shown in FIG. 7, in the fully inserted position of the male locking projections 172, the arcuate fold line 176 will be generally adjacent the slit 162. The male locking projections 172 can interact and engage the female locking openings 163 by other positioning steps or alternative features and/or arrangements without departing from the disclosure.

As shown in FIGS. 8-10, the male locking projections 172 are held in a generally upright position in the inside of the carrier 105 relative to the first and second bottom panels 30, 50 by the engagement of the foldable flaps 168 with a respective male locking projection. In one embodiment, the foldable flaps 168 are folded upward relative to the bottom panel 30 and the free edge of the foldable flaps contacts the male locking projections 172 to assist in maintaining the male locking projections in the upright position. The foldable flaps 168 comprise tabs 169 at the free edges of the flaps that are shaped to facilitate contact with the male locking projections 172 to assist in holding the male locking projections in the upright position.

After the carrier 105 is loaded with containers C, the bottom panels 30, 50 are moved apart with the first bottom panel 30 being moved in the direction of arrow A2 and the second bottom panel 50 being moved in the direction of arrow A3. The movement of the bottom panels 30, 50 is caused by the relative movement of the side panels 20, 40 outward during loading of the carrier 105 so that the carrier is tightly wrapped or fitted around the containers. Alternatively, only one of the bottom panels 30, 50 could be moved in a respective direction A2, A3. When the bottom panels 30, 50 are positioned in their final, loaded orientation (FIG. 8), the shoulders 178 are out of alignment with the cuts 162 in the first bottom panel 30 so that the shoulders contact a portion of the first bottom panel. The male locking projections 172 are "locked" and prevented from withdrawal from the female openings 163 by the interference of the shoulders 178 with the portion of the first bottom panel 30. The male locking projections 172 can be locked or engaged with the female locking openings 163 by otherwise position the aspects and features of the blank 103 without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A one-piece wrap-around carton for carrying a plurality of articles, the one-piece wrap-around carton comprising:

a top panel;

a first side panel foldably connected to the top panel;

a second side panel foldably connected to the top panel;

a first bottom panel foldably connected to the first side panel, the first bottom panel comprising a plurality of female locking openings and having a plurality of opening flaps, a respective one of the opening flaps is adjacent a respective one of the female locking openings and is respectively foldably connected to the first bottom panel at a respective first arcuate fold line; and a second bottom panel foldably connected to the second side panel, the second bottom panel comprising a plurality of male locking projections, each of the male locking projections is respectively foldably connected to the second bottom panel at a respective second arcuate fold line, wherein the first bottom panel is foldably connected to the first side panel at a fold line, each respective first arcuate fold line comprises a first distal end, a second distal end, and a medial portion between the first distal end and the second distal end, and wherein each respective first arcuate fold line has a radius of curvature such that the medial portion is positioned to be a first distance from the fold line and the first distal end and the second distal end are arranged to be a second distance from the fold line, the first distance being greater than the second distance.

2. The carton of claim 1, wherein each of the opening flaps are at least partially defined by two cuts in the first bottom panel and a slit extending between the two cuts.

3. The carton of claim 2, wherein the first bottom panel is foldably connected to the first side panel at a lateral fold line extending generally in a lateral direction, the two cuts are oblique relative to the lateral fold line.

4. The carton of claim 3, wherein each of the opening flaps is biased against a respective male locking projection to prevent disengagement of the male locking projection from the female locking opening.

5. The carton of claim 4, wherein the slit extending between the two cuts comprises portions that extend beyond the cuts, the male locking projections being prevented from disengagement from the female locking openings by engagement of the male locking projections with the portions of the slit for each of the female locking openings.

6. The carton of claim 5 wherein each of the male locking projections comprise two shoulders extending laterally outward from a neck, each of the shoulders being in engagement with a respective portion of the slit.

7. The carton of claim 6 wherein the second arcuate fold line extends across a respective neck of the male locking projections.

8. The carton of claim 5 wherein the male locking projections are in a generally upright position in the inside of the carrier relative to the first and second bottom panels.

9. The carton of claim 8 wherein the opening flaps are folded upward relative to the bottom panel and a free edge of the opening flaps contacts the male locking projections to assist in maintaining the male locking projections in the upright position.

10. The carton of claim 9 wherein the opening flaps comprise tabs at the free edges of the opening flaps that are in contact with the male locking projections and assist in holding the male locking projections in the upright position.

11. The carton of claim 1 wherein the second arcuate fold line extends across an entire width of each male locking projection.

12. The carton of claim 11 wherein the second arcuate fold line comprises at least one cut, at least a first fold line and a second fold line, the first fold line extending from a first end of the cut and the second fold line extending from a second end of the cut.

13. The carton of claim 1 wherein the second arcuate fold line has respective ends that are spaced apart from respective edges of each of the male locking projections.

14. The carton of claim 13 wherein the second arcuate fold line comprises a cut, a first fold line extending from a first end of the cut, and a second fold line extending from a second end of the cut.

15. The carton of claim 1, wherein each of the opening flaps are at least partially defined by two cuts in the first bottom panel and a slit extending between the two cuts, the two cuts each extending generally towards the fold line, each respective first arcuate fold line extending generally between respective cuts so that a respective first distal end and second distal end are generally adjacent a respective one of the two cuts and the medial portion is located generally closer to the slit than the respective first and second distal ends.

16. A blank for forming a carton for carrying a plurality of articles, the blank comprising:

a top panel;

a first side panel foldably connected to the top panel;

a second side panels foldably connected to the top panel;

a first bottom panel foldably connected to the first side panel, the first bottom panel comprising a plurality of female locking openings and having a plurality of opening flaps, a respective one of the opening flaps is adjacent a respective one of the female locking openings and is respectively foldably connected to the first bottom panel at a respective first arcuate fold line; and a second bottom panel foldably connected to the second side panel, the second bottom panel comprising a plurality of male locking projections, each of the male locking projections is respectively foldably connected to the second bottom panel at a respective second arcuate fold line, wherein the first bottom panel is foldably connected to the first side panel at a fold line, each respective first arcuate fold line comprises a first distal end, a second distal end, and a medial portion between the first distal end and the second distal end, and wherein each respective first arcuate fold line has a radius of curvature such that the medial portion is positioned to be a first distance from the fold line and the first distal end and the second distal end are arranged to be a second distance from the fold line, the first distance being greater than the second distance.

17. The blank of claim 16, wherein each of the opening flaps are at least partially defined by two cuts in the first bottom panel and a slit extending between the two cuts.

18. The blank of claim 17, wherein the first bottom panel is foldably connected to the first side panel at a lateral fold line extending generally in a lateral direction, the two cuts are oblique relative to the lateral fold line.

19. The blank of claim 18, wherein the slit extending between the two cuts comprises portions that extend beyond the cuts, the male locking projections comprise two shoulders extending laterally outward from a neck, the shoulders being for preventing disengagement with the female locking openings by engagement with the respective portions of the slit for each of the female locking openings.

20. The blank of claim 19 wherein the second arcuate fold line extends across a respective neck of the male locking projections.

21. The blank of claim 16 wherein the second arcuate fold line extends across an entire width of each male locking projection.

22. The blank of claim 21 wherein the second arcuate fold line comprises at least one cut, at least a first fold line and a second fold line, the first fold line extending from a first end of the cut and the second fold line extending from a second end of the cut.

23. The blank of claim 16 wherein the second arcuate fold line has respective ends that are spaced apart from respective edges of each of the male locking projections.

24. The blank of claim 23 wherein the second arcuate fold line comprises a cut, a first fold line extending from a first end of the cut, and a second fold line extending from a second end of the cut.

25. A method of forming a carton, the method comprising:

obtaining a blank comprising:

a top panel;

a first side panel foldably connected to the top panel;

a second side panels foldably connected to the top panel;

a first bottom panel foldably connected to the first side panel, the first bottom panel comprising a plurality of female locking openings and having a plurality of opening flaps, a respective one of the opening flaps is adjacent a respective one of the female locking openings and is respectively foldably connected to the first bottom panel at a respective first arcuate fold line; and a second bottom panel foldably connected to the second side panel, the second bottom panel comprising a plurality of male locking projections, each of the male locking projections is respectively foldably connected to the second bottom panel at a respective second arcuate fold line, wherein the first bottom panel is foldably connected to the first side panel at a fold line, each respective first arcuate fold line comprises a first distal end, a second distal end, and a medial portion between the first distal end and the second distal end, and wherein each respective first arcuate fold line has a radius of curvature such that the medial portion is positioned to be a first distance from the fold line and the first distal end and the second distal end are arranged to be a second distance from the fold line, the first distance being greater than the second distance;

at least partially overlapping the first bottom panel and the second bottom panel;

inserting the male locking projections into a respective one of the female locking openings; and placing the male locking projection into interlocking engagement with a respective one of the female locking openings.

26. The method of claim 25, wherein each of the opening flaps are at least partially defined by two cuts in the first bottom panel and a slit extending between the two cuts, the slit extending between the two cuts comprises portions that extend beyond the cuts, the placing the male locking projections into interlocking engagement comprises engaging the male locking projections with the respective portions of the slit for each of the female locking openings.

27. The method of claim 26 wherein each of the male locking projections comprise two shoulders extending laterally outward from a neck, each of the shoulders being placed into interlocking engagement with a respective portion of the slit.

28. The method of claim 27 wherein the second arcuate fold line extends across a respective neck of the male locking projections.

29. The method of claim 26 wherein the placing the male locking projections into interlocking engagement comprises engaging the male locking projections with the opening flaps to hold the male locking projections in a generally upright position in the inside of the carrier relative to the first and second bottom panels.

30. The method of claim 29 wherein the opening flaps are folded upward relative to the bottom panel and the free edge of the opening flaps contacts the male locking projections to assist in maintaining the male locking projections in the upright position.

31. The method of claim 30 wherein the opening flaps comprise tabs at the free edges of the flaps that are in contact with the male locking projections and assist in holding the male locking projections in the upright position.

32. The method of claim 25 wherein the second arcuate fold line extends across an entire width of each male locking projection.

33. The method of claim 32 wherein the second arcuate fold line comprises at least one cut, at least a first fold line and a second fold line, the first fold line extending from a first end of the cut and the second fold line extending from a second end of the cut.

34. The method of claim 25 wherein the second arcuate fold line has respective ends that are spaced apart from respective edges of each of the male locking projections.

35. The method of claim 34 wherein the second arcuate fold line comprises a cut, a first fold line extending from a first end of the cut, and a second fold line extending from a second end of the cut.

* * * * *